US007505365B2

(12) United States Patent
Chryssostomidis et al.

(10) Patent No.: US 7,505,365 B2
(45) Date of Patent: Mar. 17, 2009

(54) LORENTZ ACOUSTIC TRANSMITTER FOR UNDERWATER COMMUNICATIONS

(75) Inventors: Chryssostomos Chryssostomidis, Boston, MA (US); Daniel Sura, Palm City, FL (US); George E. M. Karniadakis, Newton, MA (US); Corey Jaskolski, Severance, CO (US); Richard Kimball, Nottingham, NH (US)

(73) Assignee: Massachusetts Institute of Technology, Cambridge, MA (US)

( * ) Notice: Subject to any disclaimer, the term of this patent is extended or adjusted under 35 U.S.C. 154(b) by 352 days.

(21) Appl. No.: 11/445,394

(22) Filed: Jun. 1, 2006

(65) Prior Publication Data

US 2007/0159925 A1 Jul. 12, 2007

Related U.S. Application Data

(60) Provisional application No. 60/757,731, filed on Jan. 10, 2006.

(51) Int. Cl.
*B06B 1/06* (2006.01)

(52) U.S. Cl. ..... 367/134; 367/147

(58) Field of Classification Search ..... 367/134, 367/140, 141, 168, 173, 178; 73/643
See application file for complete search history.

(56) References Cited

U.S. PATENT DOCUMENTS

| | | | | |
|---|---|---|---|---|
| 3,601,788 | A | 8/1971 | Stralser et al. | |
| 3,668,617 | A | 6/1972 | Brainard, II | |
| 4,308,603 | A | 12/1981 | Overby, III | |
| 4,361,879 | A | 11/1982 | Dubbelday et al. | |
| 4,434,663 | A * | 3/1984 | Peterson et al. | 73/643 |
| 5,119,343 | A * | 6/1992 | Katahara | 367/75 |
| 5,320,309 | A * | 6/1994 | Nosenchuck et al. | 244/205 |
| 5,359,574 | A * | 10/1994 | Nadolink | 367/1 |
| 5,503,020 | A * | 4/1996 | Mandracchia | 73/643 |
| 5,791,275 | A * | 8/1998 | Bandyopadhyay | 114/67 R |
| 6,220,549 | B1 * | 4/2001 | Tsunoda et al. | 244/205 |
| 6,520,455 | B2 | 2/2003 | Karniadakis et al. | |
| 2007/0159925 | A1 * | 7/2007 | Chryssostomidis et al. | 367/147 |

* cited by examiner

*Primary Examiner*—Dan Pihulic
(74) *Attorney, Agent, or Firm*—Guerin & Rodriguez LLP; William G. Guerin

(57) ABSTRACT

Described is a device for generating an acoustic signal in an electrically conductive medium such as salt water. The device of the present invention has a broadband frequency response and supports high bandwidth data transmission. Reliability is improved in comparison to conventional underwater acoustic transmitters as the device includes no moving components. In one embodiment, the device includes a parallel and alternating arrangement of electrodes and magnets. Neighboring electrodes have different voltages and neighboring magnets have opposite pole configurations such that the magnetic fields overlap the currents between the electrodes in the medium. The currents or the magnetic fields are modulated according to a data signal to generate an acoustic signal in the medium.

20 Claims, 6 Drawing Sheets

LORENTZ ACOUSTIC TRANSMITTER FOR UNDERWATER COMMUNICATIONS

RELATED APPLICATION

This application claims the benefit of the earlier filing date of U.S. Provisional Patent Application Ser. No. 60/757,731, filed Jan. 10, 2006, titled "Generation of Pressure Waves for Underwater Communications Using Electro-Magnetic Excitation," the entirety of which is incorporated herein by reference.

GOVERNMENT RIGHTS IN THE INVENTION

This invention was made with United States government support under Contract Nos. NA16RG2255 and NA16RG2288 awarded by the National Oceanic and Atmospheric Administration. The government may have certain rights in the invention.

FIELD OF THE INVENTION

The present invention relates generally to acoustic transducers and more particularly to a Lorentz acoustic transmitter for generating a communications signal in an electrically conductive medium such as salt water.

BACKGROUND OF THE INVENTION

Underwater acoustic transmitters such as acoustic modems are generally used for underwater communications in oceans, lakes and similar environments where radio frequency devices are not practical. Various types of underwater transmitters in use today are based on magnetostrictive and piezoelectric components, and moving coil elements. These transmitters are typically limited in acoustic bandwidth in comparison to land-based communication systems such as high speed cable Internet and 802.11 wireless communication systems. For example, the bandwidths of most underwater acoustic transmitters are typically less than 20 KHz and in many instances the frequency response varies significantly across the bandwidth. The restricted bandwidth is typically due to the material properties of the mechanical to acoustic transducer components used in the underwater transmitters. In addition, the frequency bands often have center frequencies determined according to the mechanical resonance frequencies of the components. Due to the limited bandwidth, the number of communications channels and the type of communications supported by conventional underwater transmitters are limited.

Current underwater acoustic transmitters have other disadvantages. The magnitude of the acoustic signal generated by an underwater acoustic transmitter limits the length of the communications path. Conventional underwater acoustic transmitters require significant power to establish and maintain communications links. Many underwater transmitters generate spatially broad acoustic signals while other transmitter generating more directional acoustic signals are typically limited in their ability to steer the acoustic signal in a desired direction. Moreover, many acoustic transmitters such as some piezoelectric transmitters employing brittle ceramics have limited mechanical reliability. In addition, many underwater transmitters are large devices and are not readily adapted for mounting to submerged structures such as underwater vessels and the underside of surface vessels.

SUMMARY OF THE INVENTION

In one aspect, the invention features a device for generating an acoustic signal in an electrically conductive medium. The device includes a first electrode and a second electrode arranged substantially parallel to each other. The electrodes are adapted to receive a first voltage and a second voltage, respectively, and to generate a current between the electrodes. The device also includes a first magnetic pole and a second magnetic pole of opposite polarities. The magnetic poles are disposed such that a magnetic field between the magnetic poles at least partially overlaps the current between the electrodes when the device is immersed in the electrically conductive medium. The acoustic signal propagates from the device in response to a Lorentz force generated in the electrically conductive medium according to at least one of a time variation in the current and a time variation in the magnetic field.

In another aspect, the invention features a device for generating an acoustic signal in an electrically conductive medium. The device includes a first electrode and a second electrode arranged substantially parallel to each other. The first and second electrodes are adapted to receive a first voltage and a second voltage, respectively, and to generate a current between the electrodes. The device also includes a first magnetic pole and a second magnetic pole. The first magnetic pole has a polarity and is disposed proximate to one side of the first electrode. The second magnetic pole has an opposite polarity and is disposed proximate to the other side of the first electrode such that a magnetic field extending between the magnetic poles overlaps the current between the electrodes. An acoustic signal is generated in response to a time variation of at least one of the current and the magnetic field when the device is immersed in the electrically conductive medium.

In another aspect, the invention features a device for generating an acoustic signal in an electrically conductive medium. The device includes a first electrode and a second electrode each having a length and arranged substantially parallel to the other in a first plane. The first and second electrodes are adapted to receive a first voltage and a second voltage, respectively, and to generate a current between the electrodes. The device also includes a first magnetic pole and a second magnetic pole each having a length and arranged substantially parallel to the other magnetic pole in a second plane substantially parallel to the first plane. A magnetic field extends between the magnetic poles overlaps the current when the device is immersed in the electrically conductive medium. The acoustic signal is generated in the electrically conductive medium in response to a time variation of at least one of the current and the magnetic field.

In another aspect, the invention features a device for generating an acoustic signal in an electrically conductive medium. The device includes a plurality of first electrodes, a plurality of second electrodes, a data signal source and a plurality of permanent magnets. The first electrodes are arranged substantially parallel to each other. The second electrodes are arranged substantially parallel to each other and to the first electrodes in a first plane. Each second electrode is disposed between a respective pair of neighboring first electrodes. The data signal source has a first terminal in electrical communication with the first electrodes and a second terminal in electrical communication with the second electrodes. A current is generated in the electrically conductive medium in response to a data signal applied at the first and second terminals of the data signal source. Each magnet has a magnetic pole in a second plane that is substantially parallel to the first plane. Each magnetic pole is substantially parallel to the magnetic poles of the other permanent magnets and has an opposite polarity of a neighboring magnetic pole. When the device is immersed in the electrically conductive medium, a magnetic field between each pair of neighboring magnetic poles overlaps the current. The acoustic signal is generated in the electrically conductive medium in response to the data signal.

In still another aspect, the invention features a method for generating an acoustic signal in an electrically conductive medium. A current is generated between a pair of electrodes in substantially parallel arrangement in the electrically conductive medium. A magnetic field is generated between a pair of magnetic poles in substantially parallel arrangement in the electrically conductive medium such that the magnetic field overlaps the current. At least one of the current and the magnetic field is modulated to generate an acoustic signal in the electrically conductive medium.

In yet another aspect, the invention features a device for receiving an acoustic signal propagating in an electrically conductive medium. The device includes a first electrode and a second electrode each configured substantially parallel to the other. The first and second electrodes are adapted to receive the acoustic signal. The device also includes a first magnetic pole and a second magnetic pole having opposite polarities and being disposed such that a magnetic field between the magnetic poles at least partially overlaps a region between the electrodes. When the device is immersed in the electrically conductive medium, a current is generated between the first and second electrodes in response to the acoustic signal.

In another aspect, the invention features a device for receiving an acoustic signal propagating in an electrically conductive medium. The device includes a first electrode and a second electrode each having a length and each arranged substantially parallel to the other in a first plane. The electrodes are adapted to receive the acoustic signal. The device also includes a first magnetic pole and a second magnetic pole each having a length and each arranged substantially parallel to the other magnetic pole in a second plane substantially parallel to the first plane. When the device is immersed in the electrically conductive medium, a current is generated between the first and second electrodes in response to the acoustic signal.

BRIEF DESCRIPTION OF THE DRAWINGS

The above and further advantages of this invention may be better understood by referring to the following description in conjunction with the accompanying drawings, in which like numerals indicate like structural elements and features in the various figures. The drawings are not necessarily to scale, emphasis instead being placed upon illustrating the principles of the invention.

DETAILED DESCRIPTION

Figure 1:
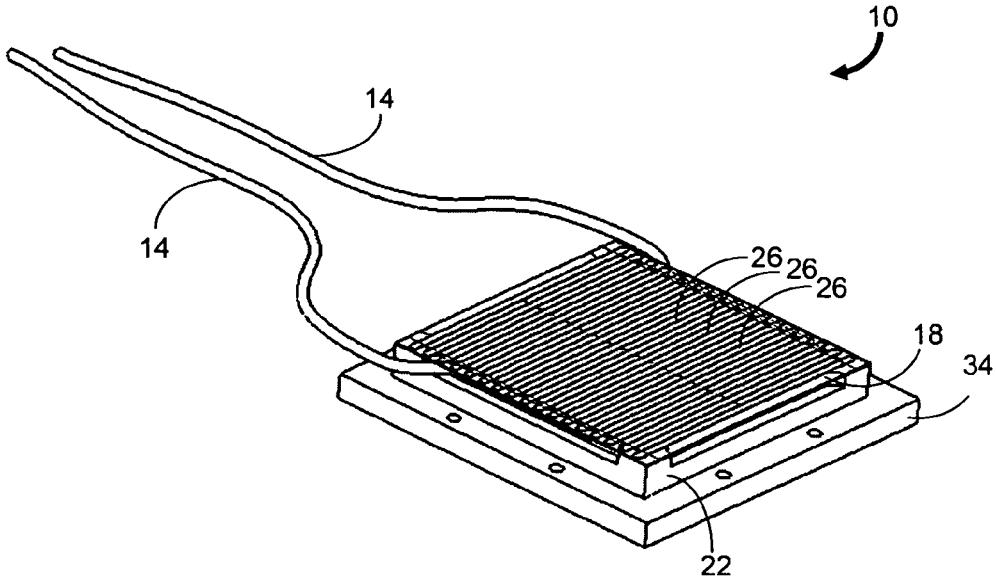
FIG. 1 illustrates an embodiment of a device for generating an acoustic signal in an electrically conductive medium according to the invention.

In brief overview, the present invention relates to a device for generating an acoustic signal in an electrically conductive medium. Unlike conventional underwater acoustic transmitters, the device of the present invention has a broadband frequency response and can support high bandwidth data transmission including, for example, video and spread spectrum communications. Moreover, reliability is improved as the device includes no moving components.

Communications data can be transmitted to one or more acoustic receivers. For example, communications data can be transmitted through salt water to or from surface vessels, underwater vessels (e.g., submarines) and other partially or fully immersed structures. Moreover, the electrically conductive medium can be any electrically conductive liquid or gas in which a Lorentz force can be generated.

As used herein, the phrase "substantially parallel" means sufficiently parallel such that a property (e.g., current density, magnetic field strength) between two components is substantially unaffected by variations from parallel. In some instances, substantially parallel items (e.g., electrodes and magnets) means items that differ in orientation by 20° or more. In one embodiment, the device includes multiple electrodes in a substantially parallel and coplanar configuration. The electrodes are alternatively coupled to one of a first voltage and a second voltage so that a current responsive to the difference in the first and second voltages is generated between neighboring electrodes. In one embodiment the first voltage is a reference voltage (i.e., "ground"). Magnetic poles disposed between the electrodes have alternating polarity and provide magnetic fields that overlap the current. A Lorentz force is generated in the electrically conductive medium by the magnetic fields and the current flowing between the electrodes. The Lorentz force results in a pressure wave, i.e., an acoustic signal, propagating from the device. The acoustic signal varies according to the time dependence of the voltage difference between neighboring electrodes, or equivalently, according to the time dependence of the current flow between neighboring electrodes. The acoustic signal propagates in the electrically conductive medium in a direction parallel to the lengths of the electrodes. According to one embodiment of the device, the alternating magnetic poles are arranged along an axis substantially parallel to the arrangement of the electrodes so that the acoustic signal propagates in a direction parallel to the electrodes. In another embodiment, the alternating magnetic poles are arranged along an axis perpendicular to the arrangement of the electrodes so that the acoustic signal propagates in a direction normal to the plane of the electrodes.

Acoustic signals generated by the device can be detected by hydrophones or similar devices used to detect acoustic energy transmitted through the electrically conductive medium. Alternatively, an acoustic receiver having a similar structure to the device of the present invention can be used to generate an electrical signal in response to an incident acoustic signal. The electrical signal is amplified and filtered to retrieve the transmitted data.

Figure 2:
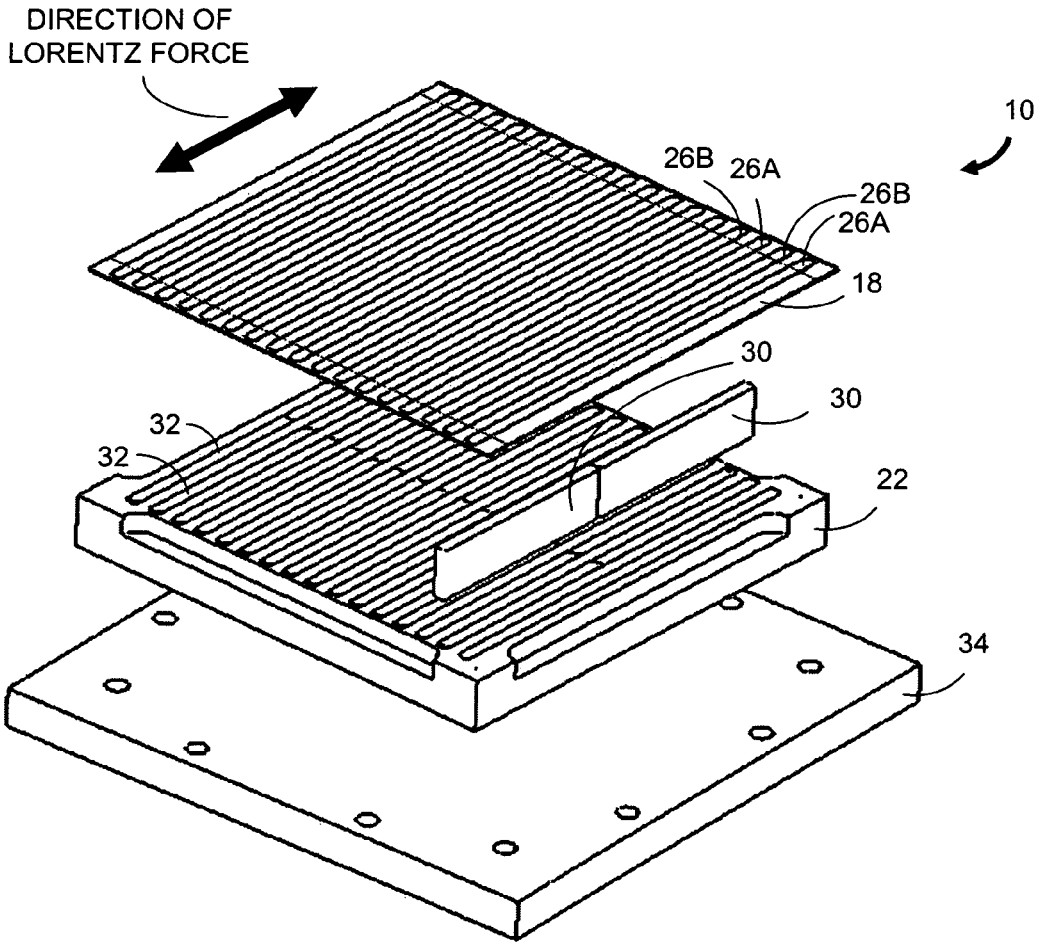
FIG. 2 is an exploded view of the device of FIG. 1.

FIG. 1 illustrates a device 10 for generating an acoustic signal in an electrically conductive medium constructed in accordance with principles of the invention. FIG. 2 shows an exploded view of the device 10 of FIG. 1. The device 10 is adapted for immersion in an electrically conductive fluid such as salt water. Electrical wires 14 are used to couple the device 10 to an electrical signal source such as a modulated current source or a modulated voltage source.

The device 10 includes a dielectric board 18 secured to a housing 22 using, for example, a marine adhesive. Electrodes 26 are arranged substantially parallel to each other on the top surface of the dielectric board 18. In one embodiment, the device 10 is approximately 4.5 inches on a side and is approximately 1.75 inch thick. In this embodiment, the electrodes 26 are 4 inches long, 0.125 inch wide and 0.060 inch thick copper traces and each magnet 30 is 2 inches long, 0.125 inch wide and 0.50 inch high. The electrodes 26 are separated from neighboring electrodes 26 by 0.125 inches. Similarly, the magnets 30 are separated from neighboring magnets 30 by 0.125 inches. The housing 22 is fabricated from a durable plastic such as Delrin® polymer manufactured by DuPont of Wilmington, Del.

Corrosive environments such as saltwater can erode the electrodes 26 and cause degradation in the performance of the device 10. The electrodes 26 preferably are coated with a material to inhibit corrosion such as enamel paint, zinc coatings, epoxy coatings and the like. Similarly, the magnets 30 can be coated to reduce or eliminate corrosion. Preferably, the thickness of the applied coatings is small to maintain a high current and magnetic field strength in the electrically conductive medium. In one embodiment, the electrodes 26 are fabricated from titanium for improved corrosion resistance and no corrosion inhibitor coating is applied. Two permanent magnets 30, such as neodymium rare earth magnets, are positioned in each internal groove 32 in the housing 22 such that one pole of each magnet 30 is disposed near the surface of the dielectric board 18 opposite the electrodes 26. The housing 22 is attached to a steel backing plate 34. The device 10 can be attached to a structure such as an outer surface of an underwater vessel or the hull of a surface vessel by securing the backing plate 34 to the structure.

Figure 3:
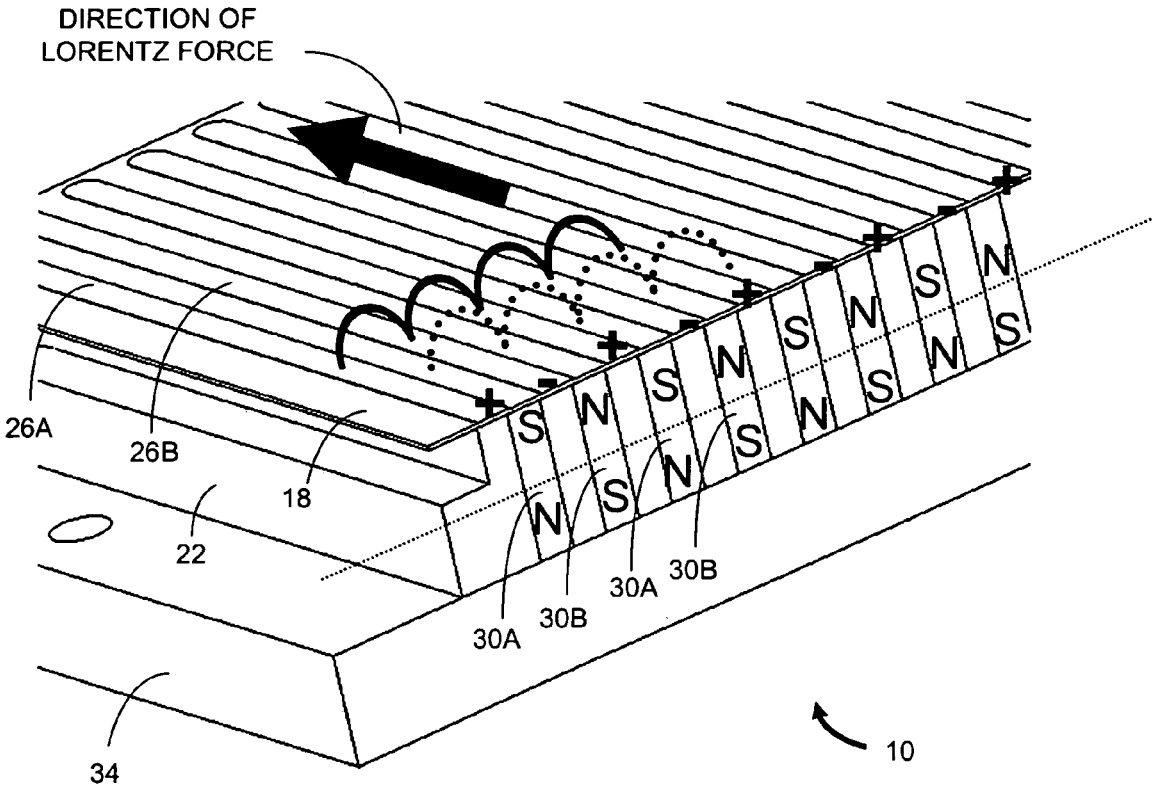
FIG. 3 shows an expanded view of a portion of the device of FIG. 1 in which electric field lines and magnetic field lines are depicted.

FIG. 3 shows an expanded view of a portion of the device 10 of FIG. 1. The permanent magnets 30 are arranged in an alternating configuration so that odd numbered magnets 30A have a magnetic south pole (S) disposed adjacent to the dielectric board 18 and even numbered magnets 30B have a magnetic north pole (N) disposed adjacent to the dielectric board 18. All odd numbered electrodes 26A are in electrical contact with an electrical path coupled to a first terminal and all even numbered electrodes 26B are in electrical contact with an electrical path coupled to a second terminal. Each terminal is electrically coupled to a data signal source through a respective wire 14 (see FIG. 1). During operation, the communications signal to be transmitted is applied as a time-dependent voltage between the two terminals. In an alternative embodiment, the communications signal is applied as a time-dependent current.

At the moment depicted in FIG. 3, the first terminal is at a higher voltage than the second terminal resulting in the positive "+" and negative "−" relative voltages on the odd electrodes 26A and even electrodes 26B, respectively. In one embodiment the voltage applied at one of the terminals is a reference voltage or "ground." The direction of current flow between the electrodes 26 changes in time according to the polarity of the voltage difference between the terminals.

Excluding variations near the edge of the device 10, the electric field lines (shown as solid arcs between electrodes 26) extend between and terminate at neighboring electrodes. As illustrated, the electric field lines are curved but it should be recognized that electric field lines closer to the plane of the electrodes 26 exhibit less curvature. Current between the electrodes 26 generally flows along the electric field lines. Similarly, magnetic field lines (shown as dashed arcs) begin and terminate at neighboring poles of the magnets 30. The steel backing plate 34 prevents the magnetic field from leaking to the underside of the device 10 where no electrodes 26 are available and therefore no Lorentz force can be generated. In the illustrated embodiment, the magnetic field remains constant in time although in other embodiments the magnetic field can be modulated to vary the Lorentz force and generate the acoustic signal.

A force is created in the electrically conductive medium due to the presence of the current and the magnetic field. In particular, the cross product of the current and the magnetic field of the device 10 yields the magnitude and direction of a Lorentz force. Thus the force is in a direction perpendicular to both the electric and magnetic vector fields. The Lorentz force as a function of position above the dielectric board 18 is given approximately by $$F = J_0 B_0 e^{-\frac{\pi}{a} y}$$

where F is the Lorentz force, $J_0$ is the maximum current density, $B_0$ is the maximum magnetic flux, a is the electrode width, electrode spacing, magnet width, and magnet spacing, and y is the distance above the plane of the electrodes 26. The Lorentz force F decays exponentially with distance y from the dielectric board 18.

The Lorentz force is varied by modulating the current, the magnetic field or both current and the magnetic field. In the illustrated device 10, the voltage difference (and current) between the electrodes 26 is varied according to a data signal. As a result, the Lorentz force varies in time to create a pressure wave, or acoustic signal, in the electrically conductive medium in response to the data signal.

Figure 4:
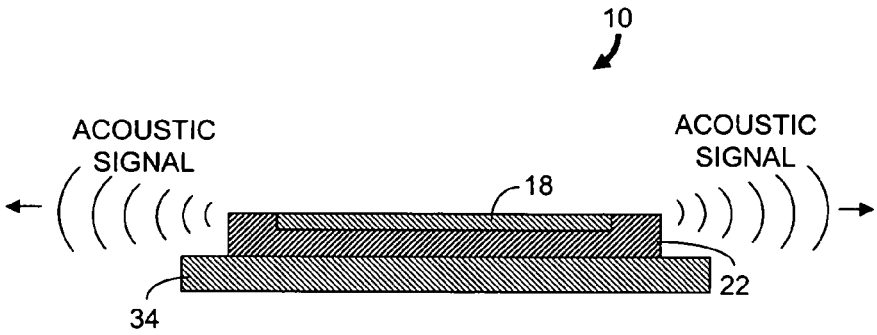
FIG. 4 illustrates a side view of the device of FIG. 1 showing bi-directional propagation of an acoustic signal.

FIG. 4 depicts a side view of the device 10 and indicates that the direction of acoustic propagation is bi-directional. That is, the pressure varies through positive and negative values resulting in the acoustic signal propagating in opposite directions. The amplitude of the acoustic signal depends on many factors, including the magnitudes of the current and the magnetic field, and the temperature and electrical conductivity of the conductive medium. For example, the amplitude of the generated acoustic signal for a device 10 immersed in salt water is greater in an environment having increased salinity due to the higher electrical conductivity.

The amplitude and frequency of the acoustic signal is controlled by adjusting the magnitude and frequency of the current flowing through the electrodes 26. The device 10 can produce an acoustic signal with frequencies from less than 10 Hz to more than 100 KHz. In one embodiment the device 10 generates an acoustic signal having an amplitude of approximately 150 dB referenced to 1 μPa at a 1 meter distance using 0.5 Tesla magnets with a 10 ampere, 4 volt rms electrical drive signal. Greater acoustic amplitudes can be achieved using other electrode designs that permit a greater current flow between the electrodes 26.

Figure 5:
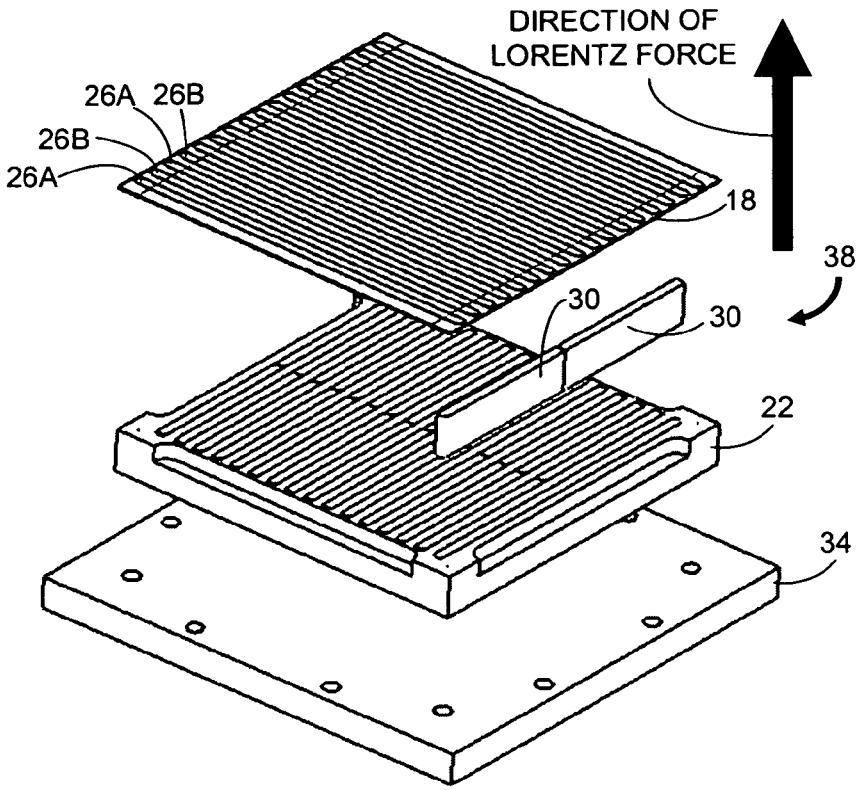
FIG. 5 illustrates an exploded view of another embodiment of a device for generating an acoustic signal in an electrically conductive medium according to the invention.

FIG. 5 illustrates an exploded view of another embodiment of a device 38 for generating an acoustic signal in an electrically conductive medium according to the invention. The design of the device 38 is substantially similar to the device 10 of FIG. 2; however, the electrodes 26 extend in a direction perpendicular to the grooves 32 and magnets 30. Consequently, the electric and magnetic fields overlap to create an acoustic signal that propagates in a direction normal to the dielectric board 18.

Figure 6:
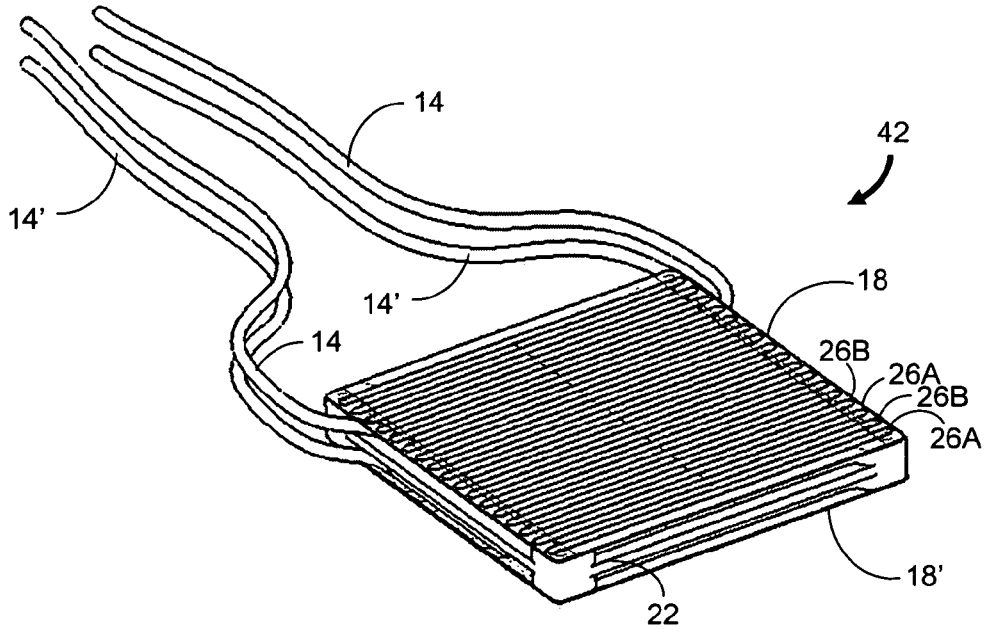
FIG. 6 illustrates another embodiment of a device for generating an acoustic signal in an electrically conductive medium according to the invention.

FIG. 6 shows another embodiment of a device 42 for generating an acoustic signal in an electrically conductive medium according to the invention. The illustrated device 42 includes components of the device 10 of FIG. 1; however, a second dielectric board 18' with electrodes 26 is included and no backing plate is utilized. An additional pair of wires 14' is utilized to carry the current for the second board 18'. The device 42 generates an acoustic signal using both dielectric boards 18 and 18'.

Figure 7:
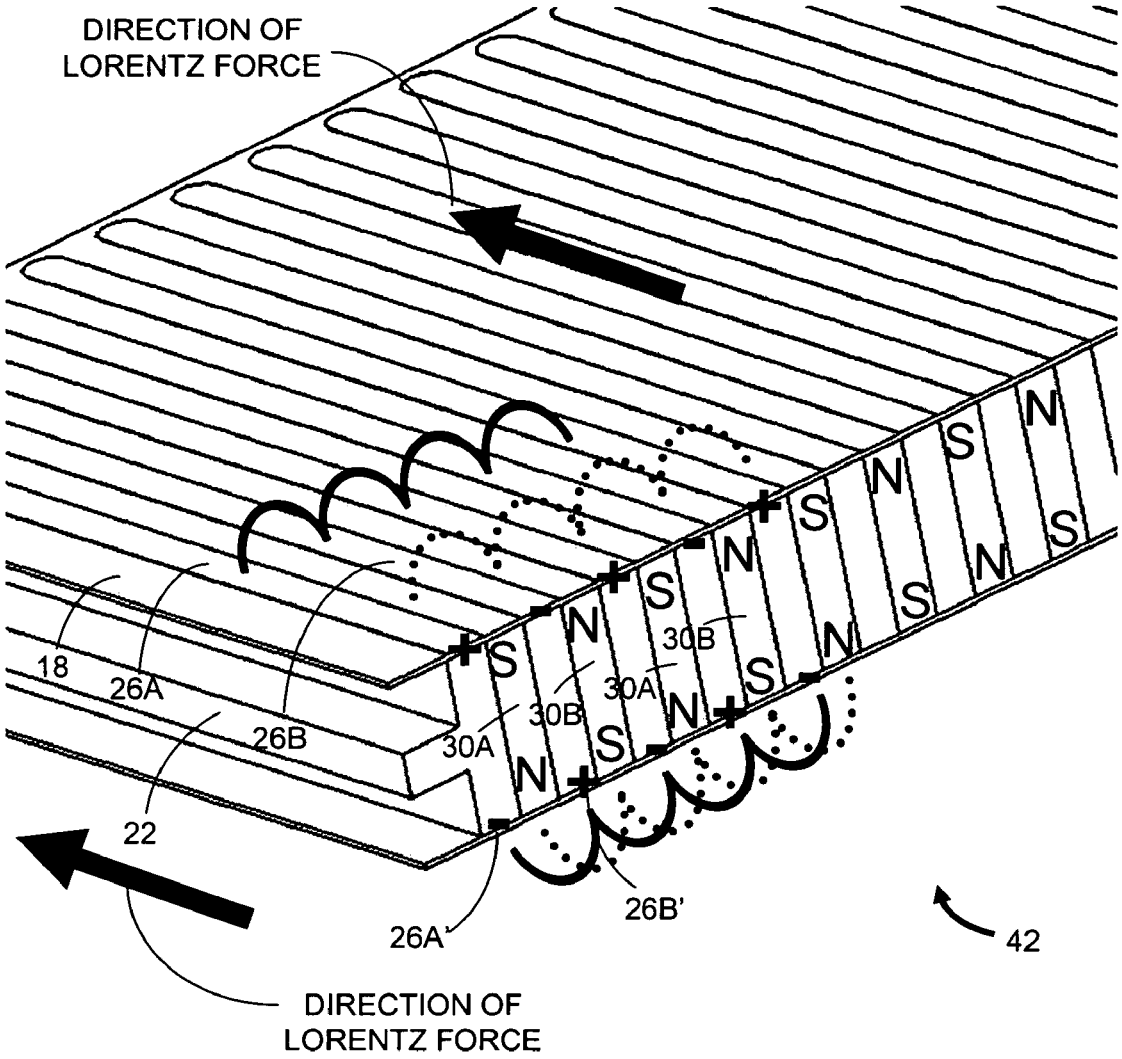
FIG. 7 shows an expanded view of a portion of the device of FIG. 6.

FIG. 7 shows an expanded view of a portion of the device 42 of FIG. 6. Electric and magnetic fields (depicted by solid arcs and dashed arcs, respectively) are generated about the electrodes 26 and magnetic poles near the top and bottom of the device 42. The current flowing between the electrodes 26 in the magnetic field results in the generation of a Lorentz force in the electrically conductive medium above and below the device 42. To ensure that the Lorentz force on each side of the device 42 points in the same direction at the same time, the voltages applied to the odd and even electrodes 26A' and 26B' of the second board 18' are opposite in polarity to the voltages applied to the odd and even electrodes 26A and 26B of the first board 18. Although power consumption is increased using the second dielectric board 18', the amplitude of the acoustic signal is increased substantially because the total Lorentz force imparted to the electrically conductive medium is approximately doubled. Advantageously, the same magnets 30 are utilized to generate the magnetic fields for both dielectric boards 18 and 18', resulting in a minimal increase in weight and cost relative to devices having only one dielectric board 18.

Figure 8:
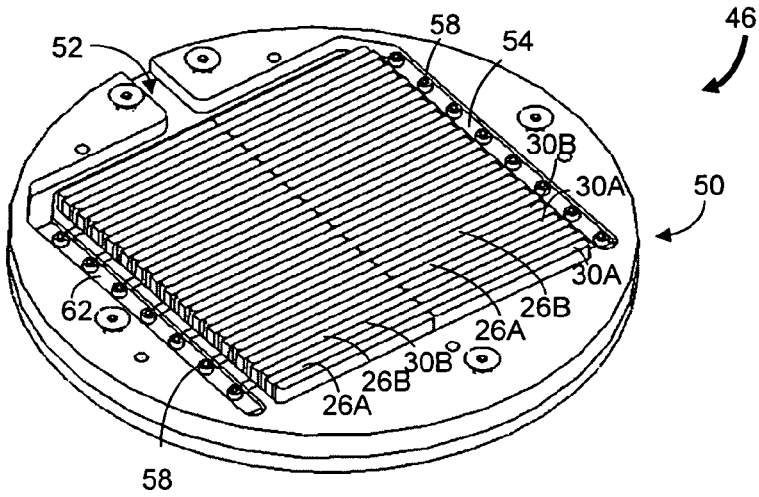
FIG. 8 illustrates another embodiment of a device for generating an acoustic signal in an electrically conductive medium according to the invention.
Figure 9:
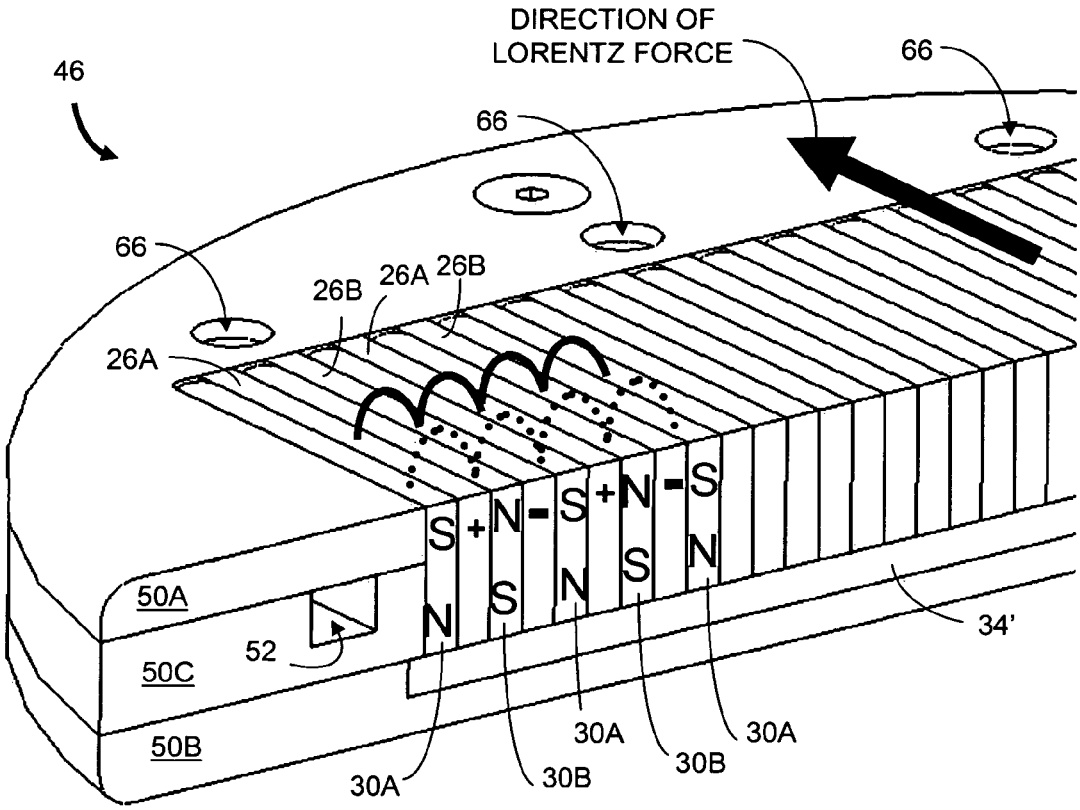
FIG. 9 shows a cross-sectional view of the device of FIG. 8 and indicates the direction of the Lorentz force at one time.

FIG. 8 shows another embodiment of a device 46 for generating an acoustic signal in an electrically conductive medium. FIG. 9 shows a cross-sectional view of the device 46 and indicates the direction of the Lorentz force at one time. In an exemplary embodiment the device 46 has a diameter of 7 inches and a thickness of 0.75 inch. The electrodes 26 are 4 inches in length, 0.125 inch wide and 0.5 inch high, and the magnets 30 are 2 inches in length, 0.125 inch wide and 0.5 inch high. Two magnets 30 are used end to end to achieve an effective total magnet length of 4 inches. Neighboring electrodes 26 are separated by approximately 0.125 inch and neighboring magnets 30 are separated by approximately 0.125 inch such that the electrodes 26 "fill" the space between neighboring magnets and magnets 30 "fill" the space between neighboring electrodes. The device 46 has improved corrosion resistance of metallic components and greater magnetic field strength at the device surface when compared to the devices described above. Wires (not shown) are used to couple the device 46 to a data signal source and driver electronics.

The device components are secured inside a three piece plastic housing 50 that includes an upper shell, lower shell and middle shell 50A, 50B and 50C, respectively. The upper shell 50A is depicted as transparent in FIG. 8 to allow viewing of the internal components. The housing 50 is manufactured from a plastic material (e.g., ABS thermoplastic) which is easy to machine, resists corrosion and provides a substantially rigid structural frame for the electrodes 26, magnets 30 and stainless steel backing plate 34'. The middle shell 50C includes channels 52 that accommodate electrical traces 54 and 62 and provide for coupling of the traces 54 and 62 to the wires. The upper shell 50A includes holes 66 aligned with the channels 52 in the middle shell 50C to provide access for pouring a urethane casting compound into the assembled device 46. The casting compound seals the internal wire connections and the electrical traces 54 and 62, and prevents corrosion caused by the operating environment.

To increase resistance to corrosion, the stainless steel backing plate 34' is painted with a marine sealant paint and the magnets 30 can be coated with a rust inhibitor. The electrodes 26 are fabricated from high grade titanium and are optionally coated to further improve corrosion resistance without sacrificing electrical conductivity.

Each odd electrode 26A is electrically and mechanically secured to a titanium trace 54 by a screw 58. Similarly, each even electrode 26B is secured to a second titanium trace 62 with a screw 58. An electrode 26 is easily replaced by removing two screws 58, removing the electrode 26, inserting a replacement electrode 26 into the vacant position, and replacing and tightening the screws 58. A layer of thin insulating material (not visible) such as vinyl tape is used to insulate the electrodes 26 along the three surfaces that would otherwise be in contact with the electrically conductive magnets 30 and stainless steel backing plate 34'. In this embodiment, the top surface of each magnet 30 is directly exposed to the electrically conductive medium thus the magnetic field strength at the surface of the device 46 is greater than for devices in which the magnets 30 are separated from the electrically conductive medium by a dielectric board.

Figure 10:
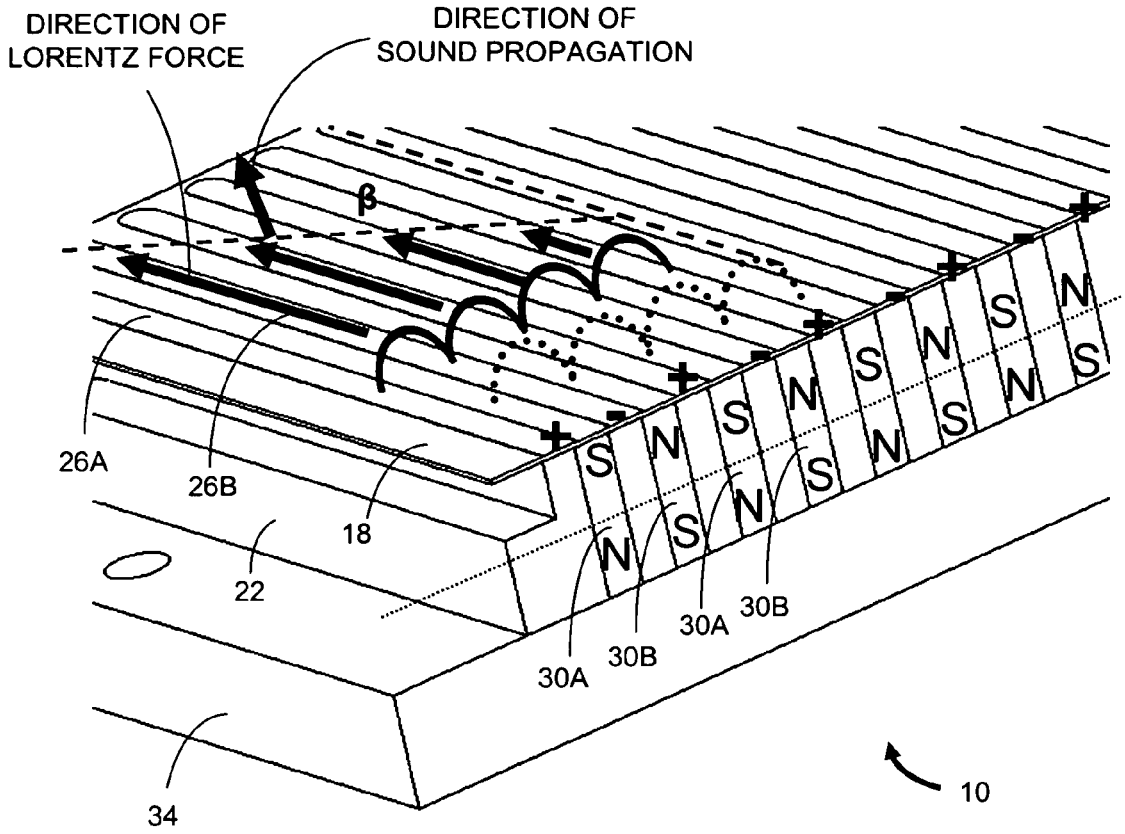
FIG. 10 depicts how steering of an acoustic signal is accomplished through control of the phase of the currents between electrodes according to their location in the device.

Acoustic transmitter devices constructed according to the invention can generate acoustic signals that can be steered through a range of direction. Referring to FIG. 10, steering is accomplished by controlling the phase of the currents between the electrodes 26 according to their location. For example, a relative phase delay $\Delta\theta$ can be imparted to the current between neighboring electrode pairs using phase delay elements such that the delay $\Delta\theta$ increases for each electrode pair with distance across the device. This linear phase delay results in a time delay in the generation of the Lorentz force along a direction coplanar with but perpendicular to the electrodes 26. Thus the acoustic signal propagates at an off-axis angle $\beta$. The magnitude of the relative phase delay $\Delta\theta$ can be changed to steer the acoustic signal.

More generally, the invention contemplates variations in the amplitude and the phase of the currents between electrode pairs according to position in the device. Thus the shape and propagation direction of the "acoustic beam" can be varied according to one or more programmed phase and amplitude relationships. In addition, the shape, size and position of the electrodes can vary to achieve a particular acoustic beam profile or propagation direction. Similarly, the shape, size, strength and position of the magnets can vary according to a desired acoustic beam and propagation direction. In one embodiment the phasing of the currents and the positions of the electrodes and magnets are chosen to enable the generation of a traveling pressure wave parallel to the plane of the electrodes.

The invention contemplates various changes in the structural features of the devices described above. For example, multiple devices for generating an acoustic signal in an electrically conductive medium can be combined as a single larger device. In one implementation of a combined device, two or more devices such as those depicted in FIGS. 1, 6 and 8 can be "stacked" with a gap between neighboring devices so that the electrically conductive medium is present between the devices. The devices can be synchronously driven to generate an acoustic signal with a substantially greater amplitude than that possible using only a single device. Alternatively, multiple devices can be configured in an array to generate an acoustic beam having a greater beamwidth than that possible from use of a single device. Alternatively, the drive signals for one or more devices can be different so that the acoustic signals can be transmitted in two or more directions.

The invention contemplates the use of electromagnets in place of or in combination with permanent magnets to achieve a desired magnetic field. Moreover, the invention contemplates generating a time-dependent magnetic field instead of or in addition to the time-dependent current. In one example, the current through electromagnets can be modulated to generate the time-dependent magnetic field. In another example, the current through the electromagnets and the current between the electrodes are both modulated to generate the acoustic signal.

While the invention has been shown and described with reference to specific embodiments, it should be understood by those skilled in the art that various changes in form and detail may be made therein without departing from the spirit and scope of the invention. For example, variations in parallelism are possible without significantly affecting the performance of the device of the invention. In another example, the invention contemplates segmented, curved and other shaped electrodes and magnets, and arrangements of electrodes and magnets.

What is claimed is:

1. A device for generating an acoustic signal in an electrically conductive medium comprising:

a dielectric board;

a first electrode and a second electrode each fixed to the dielectric board and configured substantially parallel to the other, the first and second electrodes adapted to receive a first voltage and a second voltage, respectively, and to generate a current between the electrodes; and a first magnetic pole and a second magnetic pole having opposite polarities and being disposed adjacent to the dielectric board such that a magnetic field between the magnetic poles at least partially overlaps the current between the electrodes when the device is immersed in the electrically conductive medium, wherein the acoustic signal propagates from the device in response to a Lorentz force generated in the electrically conductive medium according to at least one of a time variation in the current and a time variation in the magnetic field.

2. A device for generating an acoustic signal in an electrically conductive medium comprising:

a dielectric board;

a first electrode and a second electrode each fixed to the dielectric board and configured substantially parallel to the other, the first and second electrodes adapted to receive a first voltage and a second voltage, respectively, and to generate a current between the electrodes;

a first magnetic pole having a polarity and being disposed adjacent to the dielectric board and proximate to one side of the first electrode;

a second magnetic pole having an opposite polarity and being disposed adjacent to the dielectric board and proximate to the other side of the first electrode wherein a magnetic field extends between the magnetic poles and overlaps the current, wherein, when the device is immersed in the electrically conductive medium, an acoustic signal is generated in response to a time variation of at least one of the current and the magnetic field.

3. The device of claim 2 further comprising a voltage source in communication with the first and second electrodes to apply the first and second voltages, respectively.

4. A device for generating an acoustic signal in an electrically conductive medium comprising:

a dielectric board;

a first electrode and a second electrode each fixed to the dielectric board and each having a length and arranged substantially parallel to the other in a first plane, the first and second electrodes adapted to receive a first voltage and a second voltage, respectively, and to generate a current between the electrodes;

a first magnetic pole and a second magnetic pole each having a length and arranged substantially parallel to the other magnetic pole in a second plane substantially parallel to the first plane, wherein, when the device is immersed in the electrically conductive medium, a magnetic field extending between the magnetic poles overlaps the current and wherein the acoustic signal is generated in the electrically conductive medium in response to a time variation of at least one of the current and the magnetic field.

5. The device of claim 4 further comprising a voltage source in communication with the first and second electrodes to apply the first and second voltages, respectively.

6. A device for generating an acoustic signal in an electrically conductive medium comprising:

a dielectric board;

a plurality of first electrodes fixed to the dielectric board and arranged substantially parallel to each other;

a plurality of second electrodes fixed to the dielectric board and arranged substantially parallel to each other and to the first electrodes in a first plane, each second electrode being disposed between a respective pair of neighboring first electrodes;

a data signal source having a first terminal in electrical communication with the first electrodes and a second terminal in electrical communication with the second electrodes, wherein a current is generated in the electrically conductive medium in response to a data signal applied at the first and second terminals of the data signal source; and a plurality of permanent magnets, each permanent magnet having a magnetic pole in a second plane adjacent to the dielectric board and substantially parallel to the first plane, each magnetic pole being substantially parallel to the magnetic poles of the other permanent magnets and having an opposite polarity of a neighboring magnetic pole, wherein, when the device is immersed in the electrically conductive medium, a magnetic field between each pair of neighboring magnetic poles overlaps the current and the acoustic signal is generated in the electrically conductive medium in response to the data signal.

7. The device of claim 6 further comprising a second dielectric board having first and second electrodes, the second dielectric board disposed substantially parallel to the first dielectric board and proximate to an opposite pole of each of the permanent magnets.

8. The device of claim 6 wherein the electrodes are substantially parallel to the magnetic poles of the magnets such that the acoustic signal propagates in a direction substantially parallel to the first and second planes.

9. The device of claim 6 wherein the electrodes are substantially perpendicular to the magnetic poles of the magnets such that the acoustic signal propagates in a direction substantially normal to the first and second planes.

10. The device of claim 6 further comprising a backing plate configured substantially parallel to the first and second planes and disposed adjacent to an opposite magnetic pole of each of the magnets.

11. The device of claim 6 further comprising a plurality of adjustable phase delay elements each in communication with a respective one of the first electrodes wherein the acoustic signal is steered in response to a variation in the phase delay imparted by at least one of the phase delay elements.

12. A method for generating an acoustic signal in an electrically conductive medium, the method comprising:

generating a current between a pair of electrodes in a coplanar and substantially parallel arrangement, the electrodes being fixed to a rigid dielectric substrate immersed in the electrically conductive medium;

generating a magnetic field between a pair of magnetic poles in substantially parallel arrangement and being fixed to the rigid dielectric substrate immersed in the electrically conductive medium wherein the magnetic field overlaps the current; and modulating at least one of the current and the magnetic field to generate an acoustic signal in the electrically conductive medium.

13. The method of claim 12 wherein the electrodes and the magnetic poles are substantially coplanar.

14. The method of claim 12 wherein the generation of a current comprises generating a current between each electrode in a plurality of neighboring pairs of electrodes and wherein the generation of a magnetic field comprises generating a magnetic field between each magnetic pole in a plurality of neighboring pairs of magnetic poles.

15. The method of claim 14 further comprising changing a phase of one of the currents relative to at least one of the other currents to change a propagation direction of the acoustic signal.

16. The method of claim 14 further comprising changing a phase of one of the magnetic fields relative to at least one of the other magnetic fields to change a propagation direction of the acoustic signal.

17. The method of claim 12 wherein modulating the current comprises generating a time-dependent voltage difference between the pair of electrodes.

18. The method of claim 12 wherein modulating the magnetic field comprises generating a time-dependent current through at least one electromagnet.

19. A device for receiving an acoustic signal propagating in an electrically conductive medium comprising:

a dielectric board;

a first electrode and a second electrode each fixed to the dielectric board and each having a linear configuration and being substantially parallel to the other, the first and second electrodes adapted for immersion in the electrically conductive medium and to receive an acoustic signal propagating through the electrically conductive medium; and a first magnetic pole and a second magnetic pole having opposite polarities and being disposed adjacent to the dielectric board such that a magnetic field between the magnetic poles at least partially overlaps a region between the electrodes, wherein when the device is immersed in the electrically conductive medium a current is generated between the first and second electrodes in response to the acoustic signal.

20. A device for receiving an acoustic signal propagating in an electrically conductive medium comprising:

a dielectric board;

a plurality of electrode pairs, each electrode pair being fixed to the dielectric board and having electrodes substantially parallel to the other electrodes in a first plane, one of the electrodes in each electrode pair being adapted for application of a voltage that is complementary to a voltage applied to the other electrode in the electrode pair, the electrodes being adapted to receive the acoustic signal; and a plurality of magnetic pole pairs each disposed adjacent to the dielectric board and each having a linear configuration of magnetic poles that is substantially parallel to the magnetic poles of the other magnetic pole pairs in a second plane substantially parallel to the first plane, wherein when the device is immersed in the electrically conductive medium a current is generated between the neighboring electrodes in response to the acoustic signal.

* * * * *